US009352567B2

(12) United States Patent
Tsujiuchi et al.

(10) Patent No.: US 9,352,567 B2
(45) Date of Patent: May 31, 2016

(54) LIQUID DISCHARGING HEAD AND METHOD FOR PRODUCING THE SAME

(71) Applicant: CANON KABUSHIKI KAISHA, Tokyo (JP)

(72) Inventors: Naoko Tsujiuchi, Kawasaki (JP); Satoshi Kimura, Kawasaki (JP); Naruyuki Nojo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/723,317

(22) Filed: May 27, 2015

(65) Prior Publication Data

US 2015/0343778 A1 Dec. 3, 2015

(30) Foreign Application Priority Data

May 30, 2014 (JP) ..... 2014-112187

(51) Int. Cl.
*B41J 2/135* (2006.01)
*B41J 2/14* (2006.01)
*B41J 2/16* (2006.01)

(52) U.S. Cl.
CPC ..... *B41J 2/1433* (2013.01); *B41J 2/14024* (2013.01); *B41J 2/162* (2013.01); *B41J 2/1603* (2013.01); *B41J 2/1623* (2013.01)

(58) Field of Classification Search
CPC ..... B41J 2/1621; B41J 2/1623
USPC ..... 347/20, 44; 29/890.1
See application file for complete search history.

(56) References Cited

U.S. PATENT DOCUMENTS

2011/0225824 A1* 9/2011 Furukawa ..... B41J 2/16 29/890.1
2013/0194342 A1* 8/2013 Enomoto ..... B41J 2/1623 347/20
2014/0360595 A1* 12/2014 Fujii ..... B41J 2/17513 137/343

FOREIGN PATENT DOCUMENTS

JP 2012-240210 A 12/2012

* cited by examiner

*Primary Examiner* — Julian Huffman
*Assistant Examiner* — Sharon A Polk
(74) *Attorney, Agent, or Firm* — Canon USA, Inc., IP Division

(57) ABSTRACT

A method for producing a liquid discharging head includes an element substrate provided with a discharge opening for discharging a liquid and a supporting member that supports the element substrate, the element substrate having a first surface and a second surface opposite to the first surface, the supporting member having a height reference surface and an element-substrate bonding surface to which the first surface is bonded with an adhesive. The method includes the steps of measuring a height h of the element-substrate bonding surface from the height reference surface; applying the adhesive to the element-substrate bonding surface; and causing the first surface to oppose the element-substrate bonding surface with the adhesive being provided therebetween, and disposing the second surface at a predetermined height m from the measured height h to harden the adhesive at a portion between the element-substrate bonding surface and the element substrate.

5 Claims, 10 Drawing Sheets

LIQUID DISCHARGING HEAD AND METHOD FOR PRODUCING THE SAME

BACKGROUND OF THE INVENTION

1. Field of the Invention

The present invention relates to a liquid discharging head that discharges a liquid and to a method for producing the same.

2. Description of the Related Art

As a structure of a liquid discharging head, a structure including an element substrate and a supporting member is known. The element substrate is provided with a discharge opening row having a plurality of discharge openings for discharging a liquid as typified by ink. The supporting member is provided with a supply opening for supplying the liquid to the element substrate, and supports and is secured to the element substrate.

When producing the above-described liquid discharging head, the element substrate is bonded to the supporting member with an adhesive being provided therebetween. The precision of the position of the element substrate bonded to the supporting member considerably affects discharge characteristics of the liquid discharging head. Therefore, the element substrate is set at a predetermined position at the supporting member, and, in this state, is bonded to the supporting member.

Hitherto, as a method for positioning an element substrate in a direction (height direction) orthogonal to a surface of a supporting member to which the element substrate is bonded (hereunder referred to as "element-substrate bonding surface"), a positioning method for contacting the supporting member with and securing the supporting member to a jig, and, with a surface of the supporting member that contacts the jig being a reference surface, disposing the element substrate at a position situated at a predetermined height from the reference surface is known. In this positioning method, as regards the height of the element-substrate bonding surface of the supporting member, it is necessary to consider two types of variations mentioned below.

The first variation is a variation in the height of the element-substrate bonding surface from the reference surface. The second variation is a variation in the surface precision of the element-substrate bonding surface itself caused by, for example, warping of the supporting member.

Therefore, when the element substrate is bonded to the supporting member by the above-described positioning method, the position of the element substrate with respect to the element-substrate bonding surface is set so that the element substrate does not contact the supporting member even if these two variations are considered. Here, instead of the surface of the element substrate that opposes the supporting member (hereunder referred to as a "back surface"), a surface (hereunder referred to as a "front surface") opposite to the back surface is disposed at a predetermined height from the reference surface. This makes it possible to increase the precision of the height of the front surface of the substrate element from the reference surface regardless of the two variations mentioned above and the variation in the thickness of the element substrate.

With an adhesive being applied to the supporting member up to a position that is higher than the position of the back surface of the element substrate whose height has been set, the adhesive is sufficiently pressed and spread over the back surface of the element substrate and is made to contact the entire back surface of the element substrate. Thereafter, by hardening the adhesive, the position of the element substrate with respect to the supporting member is fixed. This positioning method is hereunder referred to as "related art 1".

In recent years, with a reduction in the size of an element substrate for the purpose of reducing the costs thereof, the area of the back surface of the element substrate to be bonded to the supporting member tends to be narrowed. In accordance with this, an application portion of an element-substrate bonding surface to which an adhesive can be applied also tends to be narrow, and the application portion, where the adhesive is applied, at the element-substrate bonding surface and an opening end of a supply opening tend to be close to each other. In this case, as the height at which the adhesive is applied is increased, it becomes more difficult to hold the adhesive on the element-surface bonding surface, as a result of which the adhesive tends to flow into the supply opening that is close to the application portion. This may occur even in the method disclosed in the related art 1.

That is, the front surface of the element substrate is disposed at a position that does not allow the back surface of the element substrate to contact the supporting member even if the variation in the height of the element-substrate bonding surface of the supporting member and the variation in the thickness of the element substrate are both considered, and the height at which the adhesive is applied is set so that, at this time, the adhesive on the supporting member is pressed and spread at the back surface of the element substrate and contacts the entire back surface of the element substrate. Therefore, even when the variation in the height of the element-substrate bonding surface to which the adhesive is actually applied is smaller than expected, it is necessary to apply the adhesive up to a set height at the element-substrate bonding surface. Consequently, the position where the adhesive is applied tends to be high.

Accordingly, with regard to the related art 1, a positioning method discussed in Japanese Patent Laid-Open No. 2012-240210 is available as a method for properly bonding an element substrate to a supporting member while reducing the height at which an adhesive is applied. The positioning method discussed in Japanese Patent Laid-Open No. 2012-240210 is a method in which a projection is provided at an element-substrate bonding surface of the supporting member and the element substrate is bonded to the supporting member at a position where the element substrate is caused to contact the projection. This method makes it possible to reduce the height at which the adhesive is applied even if the variation in the height of the element-substrate bonding surface is large.

However, in the positioning method discussed in Japanese Patent Laid-Open No. 2012-240210, since the element substrate is in contact with the projection of the element-substrate bonding surface of the supporting member, in addition to the variation in the height of the element-substrate bonding surface of the supporting member, the variation in the thickness of the element substrate also affects the precision of the height of the front surface of the element substrate from the supporting member. Therefore, compared to the related art 1, the positioning method discussed in Japanese Patent Laid-Open No. 2012-240210 has a problem in that the precision of the height of the front surface of the element substrate from the supporting member is reduced. On the other hand, the related art 1 has a problem in that, as mentioned above, the position to which the adhesive is applied is high.

SUMMARY OF THE INVENTION

According to the present invention, there is provided a method for producing a liquid discharging head including an element substrate that is provided with a discharge opening for discharging a liquid and a supporting member that supports the element substrate, the element substrate having a first surface and a second surface that is opposite to the first surface, the supporting member having a height reference surface and an element-substrate bonding surface to which the first surface is bonded with an adhesive. The method includes the steps of measuring a height h of the element-substrate bonding surface from the height reference surface; applying the adhesive to the element-substrate bonding surface; and causing the first surface to oppose the element-substrate bonding surface with the adhesive being provided therebetween, and disposing the second surface at a predetermined height m from the height h that has been measured to harden the adhesive at a portion between the element-substrate bonding surface and the element substrate.

Further features of the present invention will become apparent from the following description of exemplary embodiments with reference to the attached drawings.

DESCRIPTION OF THE EMBODIMENTS

Embodiments of the present invention are hereunder described with reference to the drawings.

First Embodiment

Figure 1:
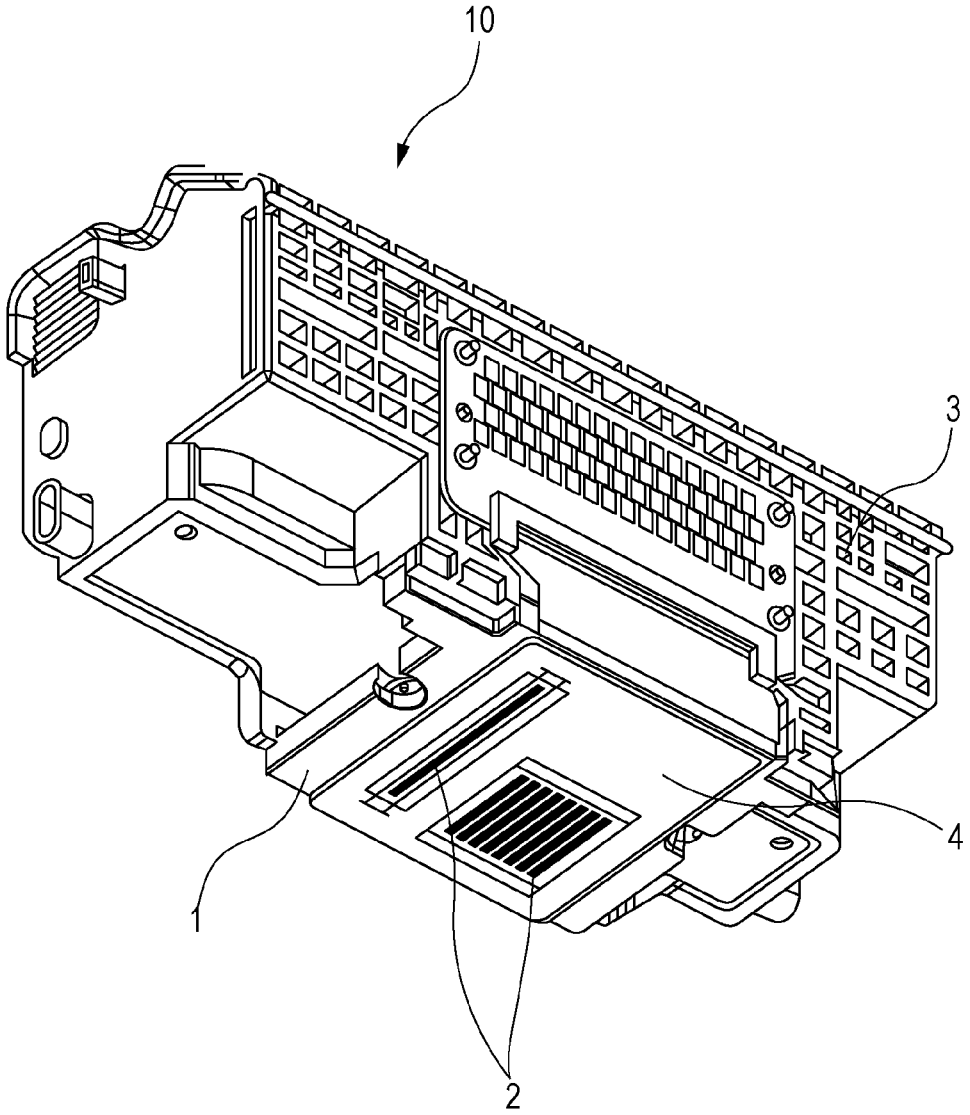
FIG. 1 is a perspective view of a liquid discharging device according to a first embodiment of the present invention.

With reference to FIG. 1, a liquid discharging head 10 according to a first embodiment includes a housing 3, an element substrate 2, and a supporting member 1. A liquid supplying portion (not shown), such as an ink tank, is removable from the housing 3. The element substrate 2 is provided with elements (such as a heater and a piezoelectric element) and discharge openings, the elements causing a liquid, such as ink, to be discharged. The supporting member 1 supports the element substrate 2. A back surface of the supporting member 1 is bonded to a side surface of the housing 3 that is caused to oppose an object to which a liquid is discharged (such as paper subjected to printing using a liquid or a substrate to be subjected to liquid processing), and the element substrate 2 is bonded to the front surface of the supporting member 1. A controlling device (not shown) that is set at an outer portion of the liquid discharging head 10 and an electric wiring member 4 that makes transmission and reception of a signal at the element substrate 2 possible are set at an outer surface of the housing 3. From the liquid supplying portion mounted on the housing 3, ink is supplied to the element substrate 2 through the housing 3 and the supporting member 1. By driving the element substrate 2 by using the electric wiring member 4, a liquid is discharged from the element substrate 2.

Figure 2:
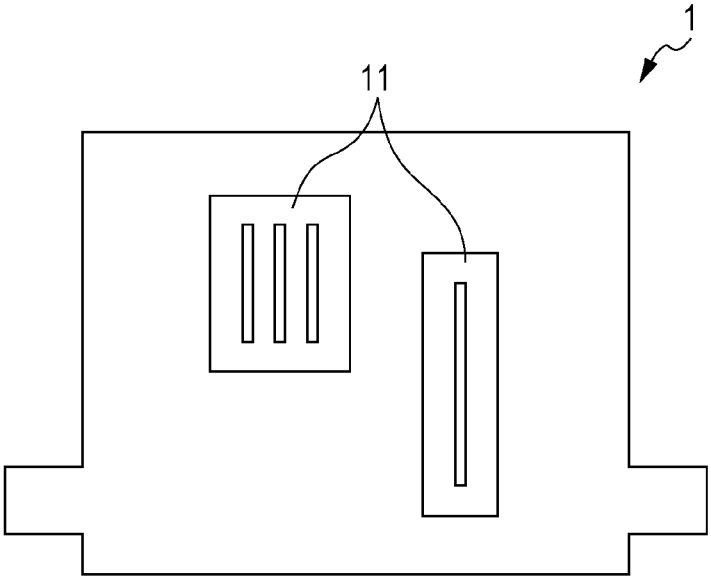
FIG. 2 is a plan view of a supporting member according to the first embodiment of the present invention.
Figure 3A:
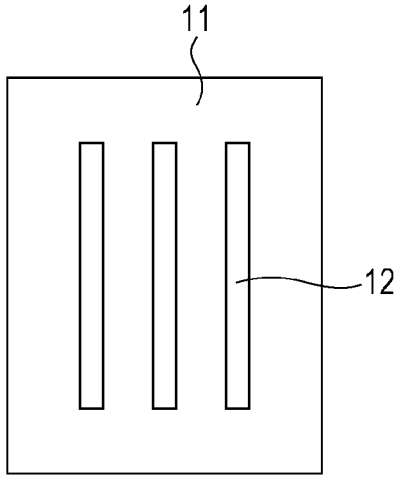
FIGS. 3A and 3B are each a plan view of an element-substrate bonding surface according to the first embodiment of the present invention.
Figure 3B:
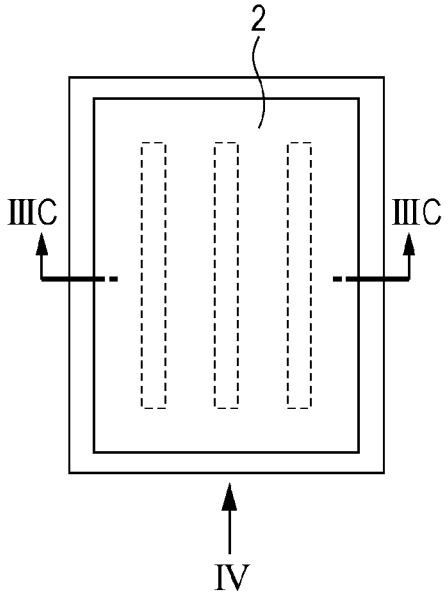
Figure 3C:
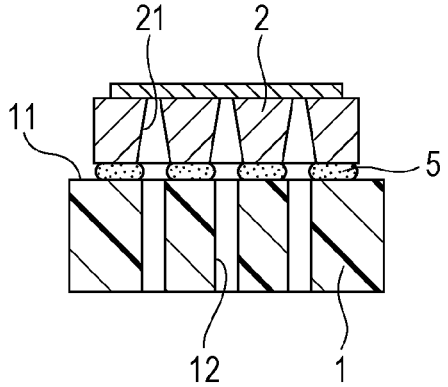
FIG. 3C is a sectional view of the element-substrate bonding surface according to the first embodiment of the present invention.

FIG. 2 is a plan view schematically illustrating the supporting member 1. The supporting member 1 is molded out of resin using a mold. A surface of the supporting member 1 to which the element substrate 2 is bonded (element-substrate bonding surface 11) is provided at the front surface of the supporting member 1. Using FIGS. 3A to 3C, a state in which the element-substrate bonding surface 11 and the element substrate 2 are bonded to each other is described. FIG. 3A is a schematic plan view of the element-substrate bonding surface 11. FIG. 3B is a plan view illustrating the state in which the element substrate is bonded to the element-substrate bonding surface 11. FIG. 3C is a sectional view taken along line IIIC-IIIC in FIG. 3B.

The element-substrate bonding surface 11 is provided with a plurality of supply openings 12 for supplying a liquid to the element substrate 2. Each supply opening 12 is rectangular. An adhesive 5 is applied to the element-substrate bonding surface 11 at portions between adjacent supply openings 12 and an outer peripheral portion of the element substrate 2 so as to surround all of the plurality of supply openings 12. By applying the adhesive 5 in this way, the element substrate 2 is bonded to the supporting member 1 such that the supply openings 12 of the supporting member 1 communicate with supply openings 21 of the element substrate 2.

Figure 4A:
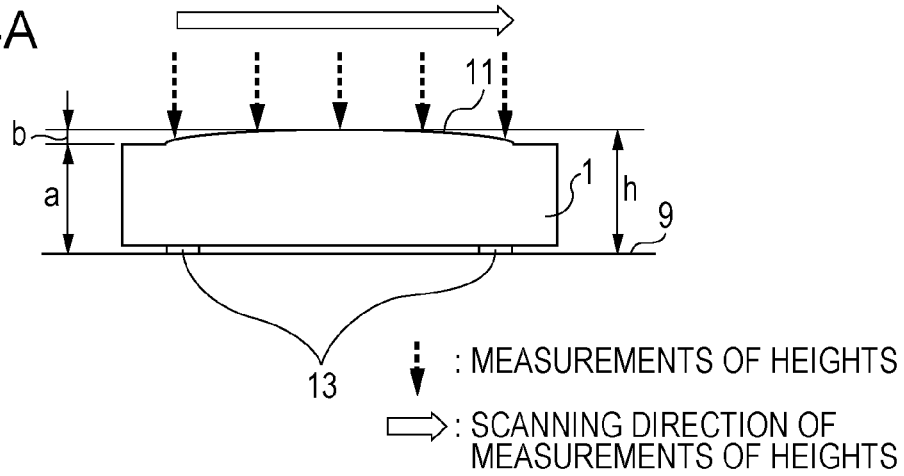
FIGS. 4A to 4C each illustrate a step for producing the liquid discharging head according to the first embodiment of the present invention.
Figure 4B:
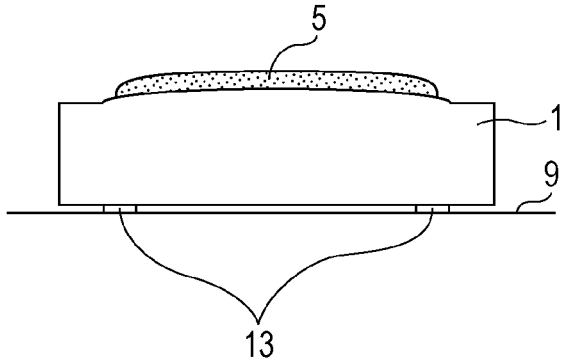
Figure 4C:
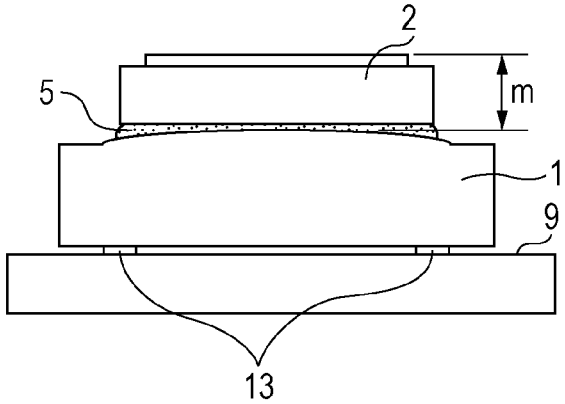

Next, steps for bonding the element substrate 2 to the supporting member 1 are described by using FIGS. 4A to 4C. FIGS. 4A to 4C illustrate the order in which the bonding steps are carried out as viewed from the direction of arrow IV in FIG. 3B.

First, the supporting member 1 is secured with a plurality of height reference surfaces 13 of the supporting member 1 being in contact with a jig 9. The jig 9 corresponds to a second supporting member that supports the supporting member 1. In the embodiment illustrated in FIGS. 4A to 4C, the plurality of height reference surfaces 13 that are provided at the back surface of the supporting member 1 are brought into contact with a flat surface of the jig 9. At this time, the plurality of height reference surfaces 13 are disposed apart from each other at suitable intervals so as to prevent the supporting member 1 from rattling.

Next, the height of the element-substrate bonding surface 11 of the supporting member 1 is measured by using a height sensor (see FIG. 4A). In the embodiment, the height is measured by using a laser sensor. The measurement method is not limited to that using a laser. However, a contact sensor may cause displacement of the supporting member to occur. Therefore, it is desirable to use a non-contact measurement method. In the embodiment, the overall height of the element-substrate bonding surface 11 is measured by scanning the element-substrate bonding surface 11 with the sensor. The dotted arrows in FIG. 4A represent the measurements of heights using the sensor, and arrow outlines with blank insides represent scanning directions when measuring the heights by using the sensor.

There are roughly two causes of variations in the height of the element-substrate bonding surface 11. One cause is a variation in the position of the entire element-substrate bonding surface from the height reference surfaces 13 of the supporting member 1. Such a variation is within a range indicated by a in FIG. 4A. The other cause is the degree of flatness (that is, degree of surface precision) depending upon, for example, warping of the element-substrate bonding surface 11 itself. The width of such a variation is indicated by b in FIG. 4A. In the measurement in the embodiment, measured values vary in the range b. In the embodiment, the largest value among the measured values is a reference height h when the element substrate 2 is to be bonded to the supporting member 1.

Next, the adhesive 5 is applied to the element-substrate bonding surface 11 (see FIG. 4B). Thereafter, the element substrate 2 is disposed. The element substrate 2 is handled by using a jig (not shown; hereunder referred to as "attracting heating jig") that is capable of attracting and heating a component. In addition, the back surface (first surface) of the element substrate 2 is caused to oppose the element-substrate bonding surface 11, and the front surface (second surface opposite to the first surface) is disposed at a position that is higher than the reference height h measured in the previous step by a predetermined height m (see FIG. 4C). At this time, in order to prevent the element substrate 2 from contacting the supporting member 1 even if variations in the thickness of the element substrate 2 are considered, the height of the front surface of the element substrate from the element-substrate bonding surface 11 is set with the adhesive being in contact with both the element substrate 2 and the supporting member 1. Further, in order for the back surface of the element substrate 2 whose front surface height has been set (that is, portions of the back surface excluding the portions where the supply openings 21 are formed) to contact the entire adhesive 5, the adhesive 5 applied to the element-substrate bonding surface 11 is sufficiently pressed and spread. With the element substrate 2 not being in contact with the supporting member 1, the adhesive 5 is hardened by heating the adhesive 5 for a short time by using the attracting heating jig. As a result, the element substrate 2 is secured to the supporting member 1 such that, in the steps subsequent to the step illustrated in FIG. 4C, the element substrate 2 is not displaced. Thereafter, the supporting member 1 to which the element substrate 2 has been bonded is bonded to the housing 3 as illustrated in FIG. 1. At this time, the height reference surfaces 13 at the supporting member 1 are bonded to the side surface of the housing 3.

In the specification, as described above, the method for bonding the supporting member 1 and the element substrate 2 to each other by hardening the adhesive 5 at a portion between the supporting member 1 and the element substrate 2 with the back surface of the element substrate 2 not being in contact with the element-substrate bonding surface 11 of the supporting member 1 is called floating mount. Although, in the embodiment, the adhesive is applied to the supporting member 1, the adhesive may be applied to the element substrate 2 or to both the supporting member 1 and the element substrate 2.

Here, the advantages of the positioning method according to the present invention that is used in the steps illustrated in FIGS. 4A to 4C are given.

According to the positioning method of the present invention, the height of the element-substrate bonding surface 11 from the height reference surfaces 13 is measured at a plurality of locations (see FIG. 4A), and the maximum height value among the measured height values is selected as the reference height h when the element substrate is bonded. Thereafter, with the front surface of the element substrate 2 being disposed at the position that is higher than the reference height h by the predetermined amount m, the element substrate 2 is bonded to the element-substrate bonding surface 11 by using the adhesive 5 (see FIG. 4C). When the element substrate 2 is bonded in FIG. 4C, in order for the back surface of the element substrate 2 whose front surface height has been set to contact the entire adhesive 5, the adhesive 5 is applied to the element-substrate bonding surface 11 and is sufficiently pressed and spread. In addition, in order to prevent the precision of the height of the element substrate from being affected by a variation in the thickness of the element substrate 2, the adhesive 5 is hardened with the element substrate 2 being separated from the element-substrate bonding surface 11. This (floating mount) makes it possible to produce a liquid discharging head in which the height of the front surface of the element substrate 2 from the supporting member 1 is highly precise.

In particular, in the case of the positioning method according to the present invention, the maximum height of the element-substrate bonding surface 11 from the height reference surface 13 is actually measured, and the front surface of the element substrate 2 is positioned at the predetermined height m from the measured maximum height as a reference. Therefore, the height at which the adhesive 5 is applied to the element-substrate bonding surface 11 can be set by excluding the effects of the aforementioned variation a (see FIG. 4A), so that it is possible to reduce the thickness to which the adhesive 5 is applied. In contrast, in the method in which the height at which the adhesive is applied is set from the reference surfaces considering the variation in the height of the element-substrate bonding surface that depends upon production precision (as in the related art), since the thickness to which the adhesive 5 is applied cannot be set by excluding the effects of the aforementioned variation a, the thickness to which the adhesive is applied tends to be large.

In short, in the method for positioning the element substrate 2 at a predetermined height from the height reference surfaces 13 of the supporting member 1 (related art 1, which has been described in the description of the related art section), it is necessary to determine the height at which the adhesive 5 is applied by considering, in addition to the variation in the thickness of the element substrate 2, the surface precision b of the element-substrate bonding surface 11 of the supporting member (see FIG. 4A) and the variation a of the position of the entire element-substrate bonding surface with respect to the height reference surfaces 13 of the supporting member 1 (see FIG. 4A). In contrast, in the positioning method according to the present invention, since the effects of the aforementioned variation a can be excluded by measuring the height of the element-substrate bonding surface 11, it is possible to reduce the thickness to which the adhesive is applied. Therefore, even when an application portion of the element-substrate bonding surface 11 to which the adhesive is applied is narrow due to a reduction in the size of the element substrate 2, the adhesive 5 does not easily flow into the supply openings 12.

In the positioning method discussed in Japanese Patent Laid-Open No. 2012-240210, in addition to the variation in the height of the supporting member 1 (the variation a in FIG. 4A), the variation in the thickness of the element substrate 2 affects the precision of the height of the front surface of the element substrate 2. In contrast, in the positioning method according to the present invention, the effects of the aforementioned variation a can be excluded by measuring the height of the element-substrate bonding surface 11. Moreover, since the front surface of the element substrate 2 is positioned at the predetermined height m with reference to the maximum height among the measured values obtained by measuring the height of the element-substrate bonding surface 11 at the plurality of locations, it is possible to exclude the effects of the variation in the thickness of the element substrate 2. Therefore, compared to the positioning method discussed in Japanese Patent Laid-Open No. 2012-240210, it is possible to increase the precision of the height of the front surface of the element substrate 2 from the supporting member 1.

Figure 5A:
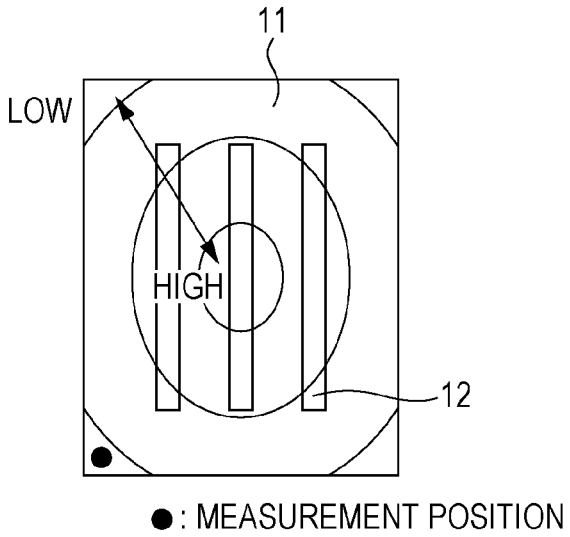
FIGS. 5A and 5B each illustrate a step for producing the liquid discharging head according to the first embodiment of the present invention.
Figure 5B:
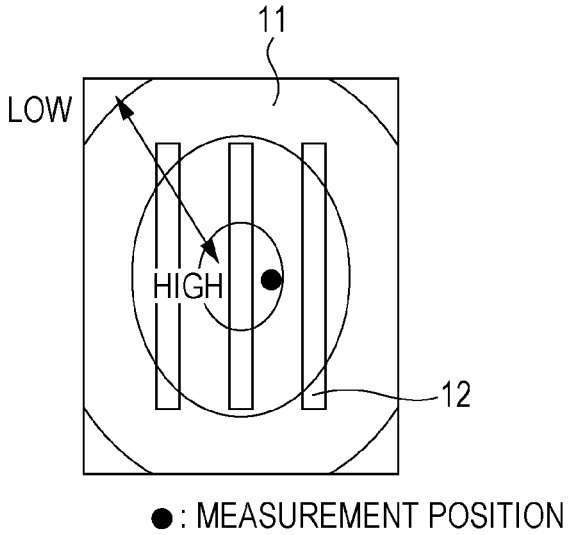

The surface precision b of the element-substrate bonding surface 11 according to the embodiment often depends upon, for example, warping of the entire supporting member 1 that occurs during injection molding, so that there is only a small difference between the tendencies of becoming rough in a plane. In such a case, as shown in FIGS. 5A and 5B, it is possible to limit the number of measurement positions, such as to a position where a most protruding portion tends to be formed in the plane of the element-substrate bonding surface 11, or to a position where a most recessed portion tends to be formed in the plane of the element-substrate bonding surface 11. That is, instead of the above-described measurement method described with reference to FIG. 4A that measures the height of the entire element-substrate bonding surface 11 by using a laser, the height of the most recessed portion or the height of the most protruding portion that is regularly formed at the supporting member 1 may be measured as illustrated in FIGS. 5A and 5B.

Figure 6A:
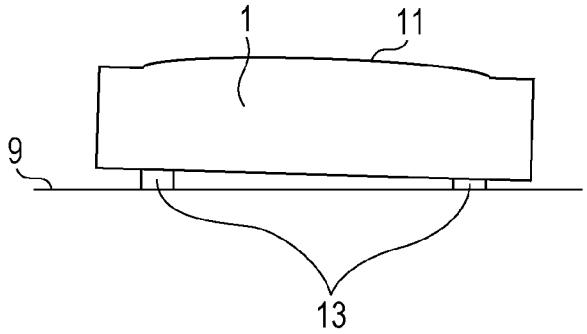
FIGS. 6A to 6C each illustrate a step for producing the liquid discharging head according to the first embodiment of the present invention.
Figure 6B:
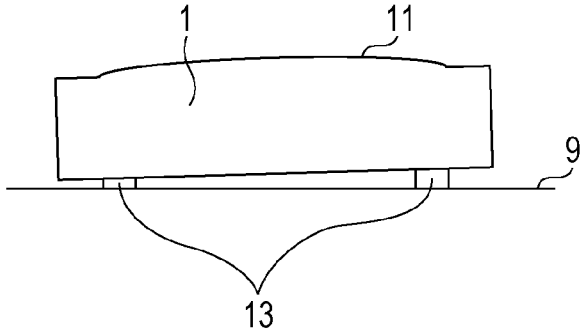
Figure 6C:
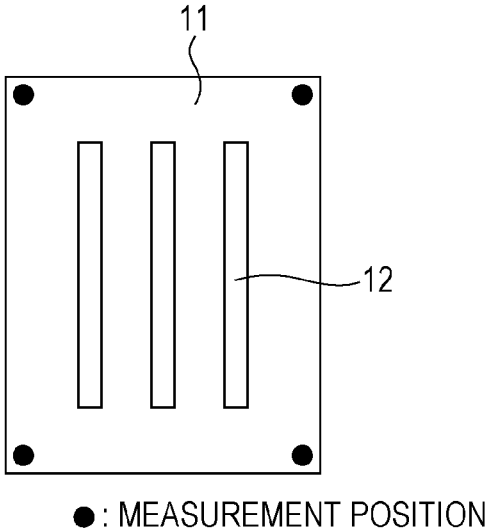

When, as illustrated in FIGS. 6A and 6B, there is a variation in the degree of parallelization of the element-substrate bonding surface 11 with respect to the height reference surfaces 13 due to, for example, a variation in the height reference surfaces 13 at the supporting member 1, a plurality of locations, such as the four corners, of the element-substrate bonding surface 11 may be subjected to measurements as illustrated in FIG. 6C. This makes it possible to perform positioning with high reliability even if there is a variation in the degree of parallelization. As described above, by limiting the measurement positions of the element-substrate bonding surface 11, it is possible to reduce the tact time of the process while maintaining reliability.

Second Embodiment

Next, a second embodiment of the present invention is described. The overall structure of a liquid discharging head according to the second embodiment is similar to that according to the first embodiment. Therefore, a description thereof is not given.

Figure 7A:
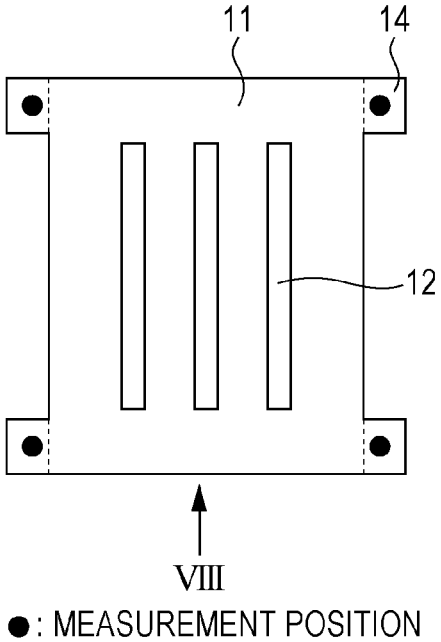
FIGS. 7A and 7B are each a plan view of an element-substrate bonding surface according to a second embodiment of the present invention.
Figure 7B:
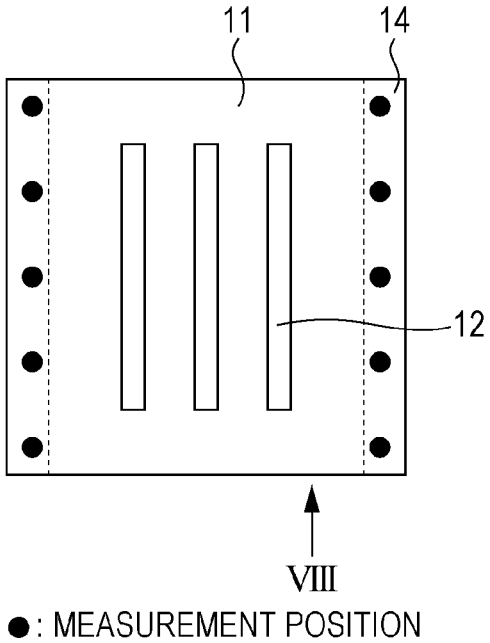

In the second embodiment, as illustrated in FIGS. 7A and 7B, with regard to the measurement positions of the aforementioned element-substrate bonding surface 11, height measurement surfaces 14 are continuously formed from an element-substrate bonding surface 11 of a supporting member 11. The height of the element-substrate bonding surface 11 and the height of each measurement surface 14 are the same. In the second embodiment, the height measurement surfaces 14 are provided adjacent to portions where the heights from height reference surfaces 13 tend to become smallest within the element-substrate bonding surface 11.

Figure 8A:
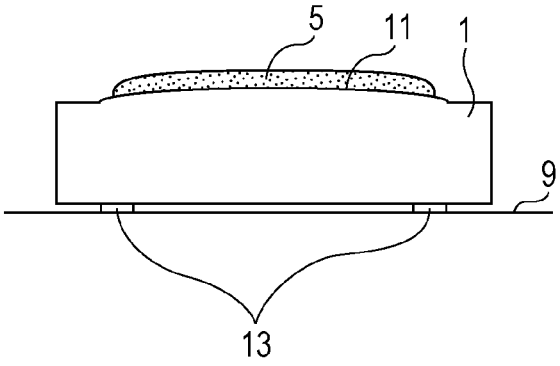
FIGS. 8A to 8C each illustrate a step for producing a liquid discharging head according to the second embodiment of the present invention.
Figure 8B:
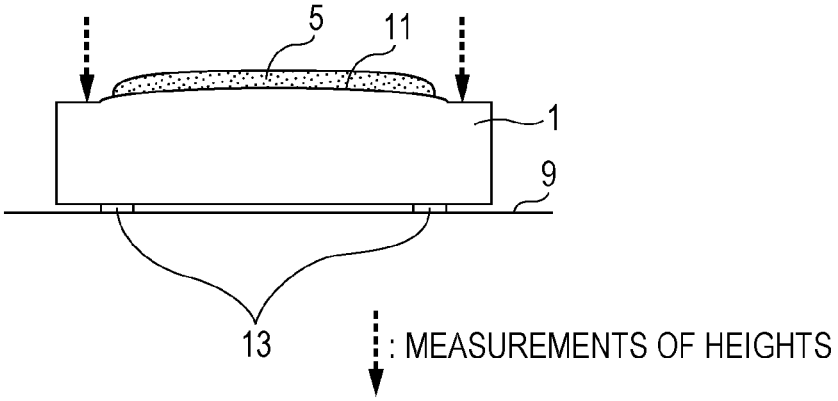
Figure 8C:
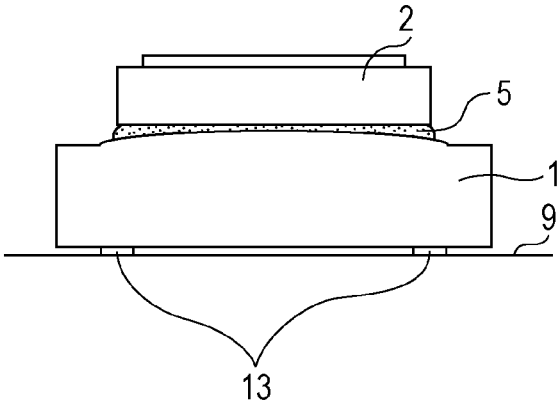

Next, the steps for bonding the element substrate 2 to the supporting member 1 are described with reference to FIGS. 8A to 8C. FIGS. 8A to 8C illustrate the order in which the bonding steps are carried out as viewed from the direction of arrow VIII in FIGS. 7A and 7B.

In the second embodiment, first, an adhesive 5 is applied to the element-substrate bonding surface 11 (see FIG. 8A). Next, the supporting member 1 to which the adhesive 5 has been applied is secured with the height reference surfaces 13 being in contact with a jig 9. The jig 9 is a second supporting member that supports the supporting member 1. As in the first embodiment, even in the second embodiment illustrated in FIGS. 8A to 8C, the height reference surfaces 13 that are provided at a back surface of the supporting member 1 are brought into contact with a flat surface of the jig 9. At this time, the plurality of height reference surfaces 13 are disposed apart from each other at suitable intervals so as to prevent the supporting member 1 from rattling.

After the supporting member 1 has been brought into contact with the jig 9, the heights of the height measurement surfaces from the height reference surfaces 13 at the supporting member 1 are measured by using a laser measuring unit (not shown) (see FIG. 8B). The dotted arrows in FIG. 8B represent the measurements of the heights performed on the height measurement surfaces 14. According to the second embodiment, since the height measurement surfaces 14 are provided at an outer side of a region occupied by the element-substrate bonding surface 11, even after the application of the adhesive, it is possible to measure the heights of the height measurement surfaces 14 without being affected by the adhesive.

Next, the element substrate 2 is handled by using an attracting heating jig, the front surface of the element substrate 2 is disposed at a position that is higher by a predetermined height from the measured heights obtained in the previous step, and the back surface of the element substrate 2 is caused to oppose the element-substrate bonding surface 11 (see FIG. 8C). At this time, the aforementioned floating mount is carried out. Then, with the element substrate 2 not being in contact with the supporting member 1, the adhesive 5 is hardened by heating for a short time using the attracting heating jig. As a result, the element substrate 2 is secured to the supporting member 1, so that the element substrate 2 is not displaced in the steps subsequent to the step illustrated in FIG. 8C.

Thereafter, the supporting member 1 to which the element substrate 2 has been bonded is bonded to a housing 3 such as that shown in FIG. 1. At this time, the height reference surfaces 13 at the supporting member 1 are bonded to a side surface of the housing 3.

In the first embodiment, the step for measuring the height of the element-substrate bonding surface 11 of the supporting member 1 (see FIG. 8B) and the step for disposing the element substrate 2 with respect to the element-substrate bonding surface 11 (see FIG. 8C) are successively performed. Therefore, the measurement of the height of the element-substrate bonding surface 11 and the disposing of the element substrate 2 can be performed in the same station. Consequently, there is no possibility of the element substrate being displaced due to movement between stations. As a result, it is possible to position the element substrate 2 with higher precision.

A plurality of height measurement surfaces 14 may be disposed adjacent to the four corners of the rectangular element-substrate bonding surface 11, respectively (see FIG. 7A). Alternatively, a height measurement surface 14 may be disposed at one of the four corners. Still alternatively, a plurality of height measurement surfaces 14 may be disposed along one or more sides at an outer periphery of the element-substrate bonding surface 11 (see FIG. 7B). In order to reduce the effects of warping of the supporting member 1, it is desirable that the measurement positions be close to the element-substrate bonding surface 11.

Third Embodiment

Next, a third embodiment of the present invention is described. In the third embodiment, the overall structure of the liquid discharging head and the steps for bonding the element substrate are similar to those according to the second embodiment. The third embodiment differs from the second embodiment in the structure of an element-substrate bonding surface 11 and the structure of height measurement surfaces 14.

Figure 9:
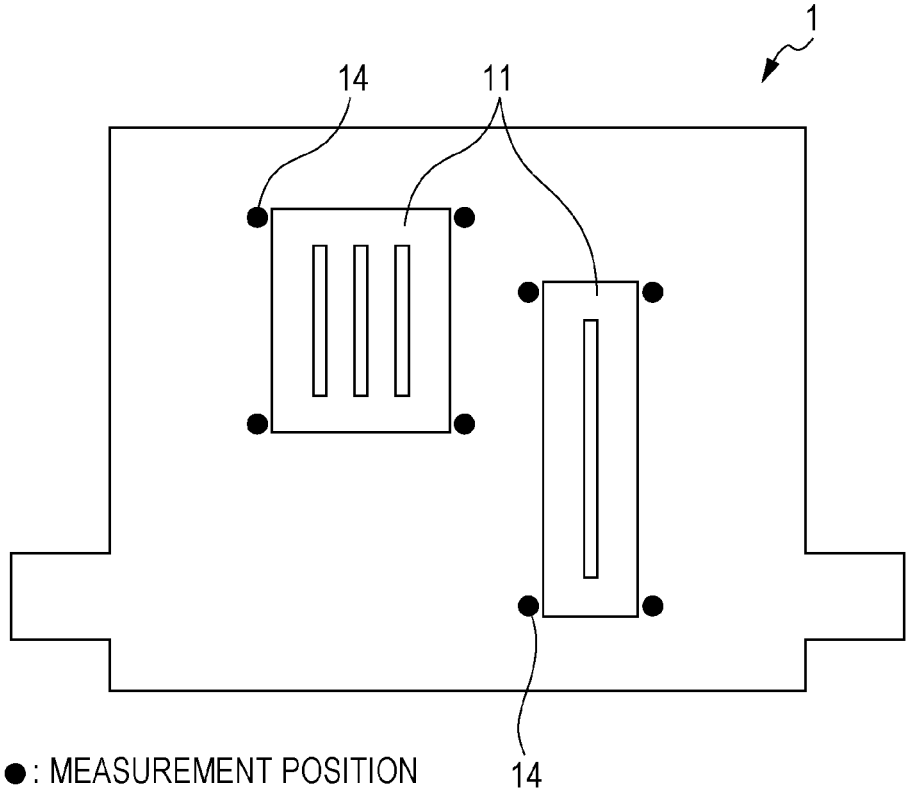
FIG. 9 is a plan view of a supporting member according to a third embodiment of the present invention.

The element-substrate bonding surface 11 and the height measurement surfaces 14 according to the third embodiment are illustrated in FIG. 9. In the third embodiment, the height of the element-substrate bonding surface 11 and the height of the height measurement surfaces 14 are the same, and the height measurement surfaces 14 are separated from the element-substrate bonding surface 11. As mentioned above, it is desirable that the height measurement surfaces 14 be close to the element-substrate bonding surface 11. However, in the second embodiment, for example, when an adhesive having a low thixotrophy is used, the adhesive 5 may flow out to the height measurement surfaces 14. By separating the element-substrate bonding surface 11 from each of the height measurement surfaces 14 as in the third embodiment, even if the height measurement surfaces 14 are provided close to the element-substrate bonding surface 11, the adhesive 5 applied to the element-substrate bonding surface 11 does not flow to the height measurement surfaces 14. As a result, when measuring the heights after applying the adhesive, it is possible to stably measure the heights. By forming the height measurement surfaces 14 into independently small surfaces, it is possible to increase the surface precision of the height measurement surfaces 14, so that the heights can be stably measured.

If a portion of an injection mold (used for molding the supporting member 1 out of resin) corresponding to the height measurement surfaces 14 is formed into a pin structure, it is possible to, for example, finely adjust the heights of the height measurement surfaces 14 in correspondence with the warp tendencies of corresponding cavities of the mold. By this, even if the supporting member 1 is molded by using a mold having a plurality of cavities, it is possible to reduce the effects between molding variations at the corresponding cavities, so that it is possible to increase the precision of the height of the element substrate 2 from the supporting member 1.

It is possible to apply the adhesive after measuring the heights (as in the first embodiment) by using the structure of the supporting member 1 according to the second embodiment or the third embodiment. However, as mentioned above, in order to reduce the possibility of displacement of the element substrate caused by the movement of the element substrate between stations, it is desirable that the heights be measured after the application of the adhesive.

Although, in the first to third embodiments, a liquid storing portion, such as an ink tank, is removable from the liquid discharging head 10 as illustrated in FIG. 1, the present invention is applicable to a liquid discharging head and a liquid storing portion that are integrated with each other.

Figure 10A:
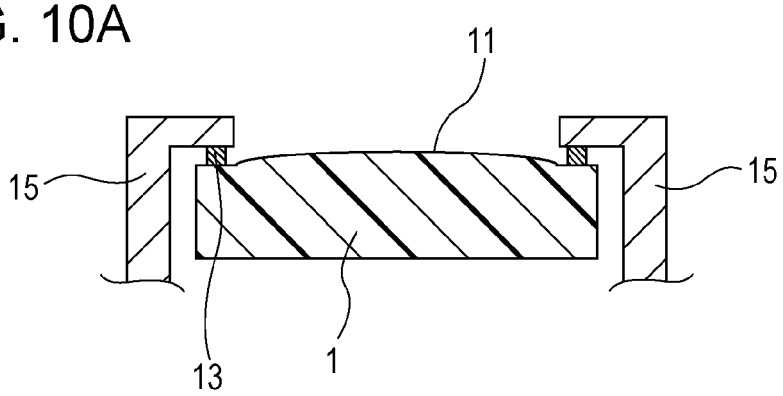
FIGS. 10A to 10C each illustrate a step for producing a liquid discharging head according to another embodiment of the present invention.
Figure 10B:
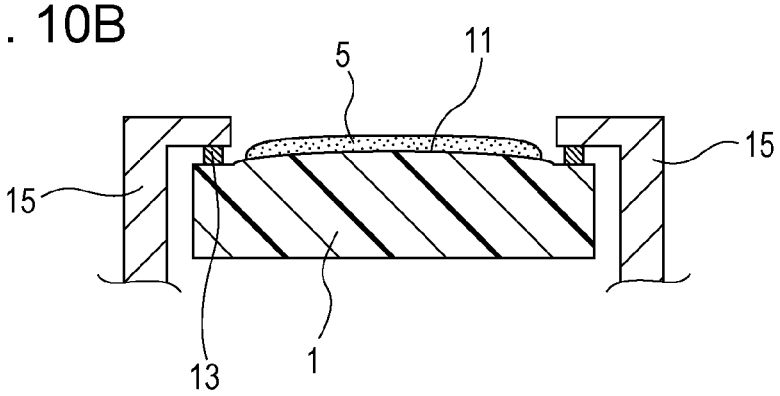
Figure 10C:
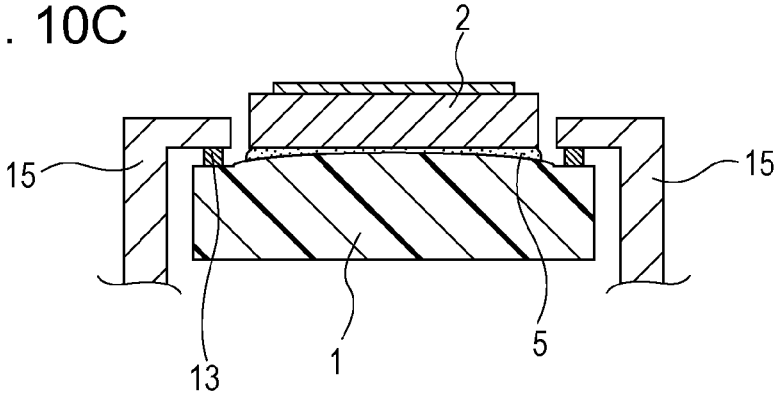

Further, in the first to third embodiments, by using a method for contacting the height reference surfaces 13, which are provided at the back surface of the supporting member 1, with a flat surface of the jig 9 serving as a second supporting member that supports the supporting member 1, the height of the element-substrate bonding surface 11 is measured. However, in the present invention, as illustrated in FIG. 10, a plurality of height reference surfaces 13 when the height of the element-substrate bonding surface 11 is measured may be provided on the front surface of the supporting member 1. In this case, each height reference surface 13, provided at the front surface of the supporting member 1, is brought into contact with its corresponding surface of the jig 15 in the same plane, after which, by using a laser measuring unit (not shown), the height of the element-substrate bonding surface 11 from the height reference surfaces 13 of the supporting member 1 is measured (see FIG. 10A). Next, the adhesive 5 is applied to the element-substrate bonding surface 11 (see FIG. 10B). Thereafter, the element substrate 2 is handled by using an attracting heating jig (not shown), the front surface of the element substrate 2 is disposed at a position that is higher by a predetermined height from the measured heights obtained in the previous step, and the back surface of the element substrate 2 is caused to oppose the element-substrate bonding surface 11 (see FIG. 10C). Then, with the element substrate 2 not being contact with the supporting member 1, the adhesive 5 is hardened by heating the adhesive 5 for a short time by using the attracting heating jig. As a result, the element substrate 2 is secured to the supporting member 1 such that, in the steps subsequent to the step illustrated in FIG. 10C, the element substrate 2 is not displaced. It is desirable that the jig 15 have a shape that allows the element-substrate bonding surface 11 of the supporting member 1 to be exposed so as to allow the height of the element-substrate bonding surface 11 to be measured, the adhesive 5 to be applied to the element-substrate bonding surface 11, and the element substrate 2 to be disposed with respect to the element-substrate bonding surface 11.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-112187, filed May 30, 2014, which is hereby incorporated by reference herein in its entirety.

What is claimed is:

1. A method for producing a liquid discharging head including an element substrate that is provided with a discharge opening for discharging a liquid and a supporting member that supports the element substrate, the element substrate having a first surface and a second surface that is opposite to the first surface, the supporting member having a height reference surface and an element-substrate bonding surface to which the first surface is bonded with an adhesive, the method comprising the steps of:

measuring a height h of the element-substrate bonding surface from the height reference surface;

applying the adhesive to the element-substrate bonding surface; and causing the first surface to oppose the element-substrate bonding surface with the adhesive being provided therebetween, and disposing the second surface at a predetermined height m from the height h that has been measured to harden the adhesive at a portion between the element-substrate bonding surface and the element substrate.

2. The method according to claim 1, wherein a laser is used as a unit configured to measure the height h.

3. The method according to claim 1, wherein a portion where the height h is measured is the entire element-substrate bonding surface.

4. The method according to claim 1, wherein, when the element-substrate bonding surface is rectangular, a portion where the height h is measured is one of four corners or more than one of the four corners of the element-substrate bonding surface.

5. A method for producing a liquid discharging head including an element substrate that is provided with a discharge opening for discharging a liquid and a supporting member that supports the element substrate, the element substrate having a first surface and a second surface that is opposite to the first surface, the supporting member having a height reference surface and an element-substrate bonding surface to which the first surface is bonded with an adhesive, the method comprising the steps of:

measuring a height h of the element-substrate bonding surface from the height reference surface;

applying the adhesive to the element-substrate bonding surface; and with the element-substrate bonding surface and the first surface opposing each other with the adhesive therebetween and the adhesive being in contact with both of the element-substrate bonding surface and the first surface, disposing the second surface at a predetermined height m from the height h that has been measured, and hardening the adhesive at a portion between the element-substrate bonding surface and the element substrate.

* * * * *